US007479036B2

(12) United States Patent
Briant et al.

(10) Patent No.: US 7,479,036 B2
(45) Date of Patent: Jan. 20, 2009

(54) MOVABLE CONNECTOR BRACKET FOR END MOUNTING PANEL MEMBERS

(75) Inventors: Eric David Briant, Dillsburg, PA (US); Scott Anthony Shuey, Harrisburg, PA (US); Michael Warren Fogg, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 3 days.

(21) Appl. No.: 11/623,197

(22) Filed: Jan. 15, 2007

(65) Prior Publication Data

US 2008/0171468 A1 Jul. 17, 2008

(51) Int. Cl.
*H01R 13/648* (2006.01)

(52) U.S. Cl. ..... 439/609; 439/939

(58) Field of Classification Search ..... 439/92, 439/95, 108, 607–610, 931, 939
See application file for complete search history.

(56) References Cited

U.S. PATENT DOCUMENTS

| | | | | | |
|---|---|---|---|---|---|
| 5,167,516 | A * | 12/1992 | Tan et al. | ..... | 439/141 |
| 5,752,854 | A * | 5/1998 | Capp et al. | ..... | 439/607 |
| 6,210,228 | B1 * | 4/2001 | Simmel et al. | ..... | 439/609 |
| 6,508,670 | B1 * | 1/2003 | Hwang | ..... | 439/607 |
| 7,074,057 | B2 * | 7/2006 | Chiran et al. | ..... | 439/92 |
| 7,322,854 | B2 * | 1/2008 | Long et al. | ..... | 439/607 |
| 2007/0128936 | A1 * | 6/2007 | Long et al. | ..... | 439/607 |
| 2007/0128937 | A1 * | 6/2007 | Long et al. | ..... | 439/607 |
| 2008/0038959 | A1 * | 2/2008 | Barringer et al. | ..... | 439/607 |
| 2008/0171468 | A1 * | 7/2008 | Briant et al. | ..... | 439/607 |

* cited by examiner

*Primary Examiner*—James Harvey

(57) ABSTRACT

A connector assembly configured for mounting on a panel member includes a connector having an axis. An EMI bracket surrounds the connector, the EMI bracket being relatively movable along the axis while maintaining electrical communication with the connector.

15 Claims, 5 Drawing Sheets

MOVABLE CONNECTOR BRACKET FOR END MOUNTING PANEL MEMBERS

FIELD OF THE INVENTION

The present invention relates generally to electrical connector brackets and, more particularly, to electrical connector brackets for use with electrical panel members.

BACKGROUND OF THE INVENTION

Connectors are required to provide electrical power or electrical or electronic control signals between components, such as computers, printers, auxiliary hardware, etc. Often, these components contain panel members, such as printed circuit boards, which are populated with miniaturized components to provide the desired electrical control. Typically, the connector is affixed adjacent to one end of the panel member. A bezel is affixed to the panel member adjacent to the connector to minimize electromagnetic interference (EMI). EMI is defined as any electromagnetic radiation released by an electronic device that disrupts the operation or performance of another device. However, due to tolerance build-up during manufacturing associated with locating the connector and bezel, resulting in inconsistent separation distances and/or misalignment between the connector and bezel, consistently adequate EMI shielding or minimization between these components has proven extremely difficult to achieve.

What is needed is a connector for use with an electrical connector assembly that is secured to a panel member, which minimizes EMI.

SUMMARY OF THE INVENTION

The present invention relates to a connector assembly including a connector configured for mounting on a panel member, the connector having an axis. An EMI bracket is at least partially surrounding the connector, the EMI bracket being relatively movable along the axis while maintaining electrical communication with the connector.

The present invention further relates to a connector assembly including a connector configured for mounting on a panel member, the connector having an axis. An EMI bracket at least partially surrounds the connector, the EMI bracket being relatively movable along the axis while maintaining electrical communication with the connector. The EMI bracket is affixed to and in electrical communication with a bezel, and a layer of conductive material is disposed between the EMI bracket and the bezel.

The present invention yet further relates to a method for assembling a connector assembly. The steps of the method include providing a panel member, a connector having an axis, a bezel, a layer of conductive material and an EMI bracket. The method further includes mounting the connector on the panel member and at least partially surrounding the connector with the EMI bracket, the EMI bracket being relatively movable along the axis while maintaining electrical communication with the connector. The method further includes inserting the layer of conductive material between the EMI bracket and the bezel and affixing the EMI bracket to the bezel, the EMI bracket in electrical communication with the bezel.

An advantage of the present invention is that EMI associated with panel member electrical connections is consistently minimized.

A further advantage of the present invention is that the electrical connections between connectors and bezels which minimize EMI do not place undue strain on the mechanical joints securing the connectors to panel members and/or bezels to the connectors.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
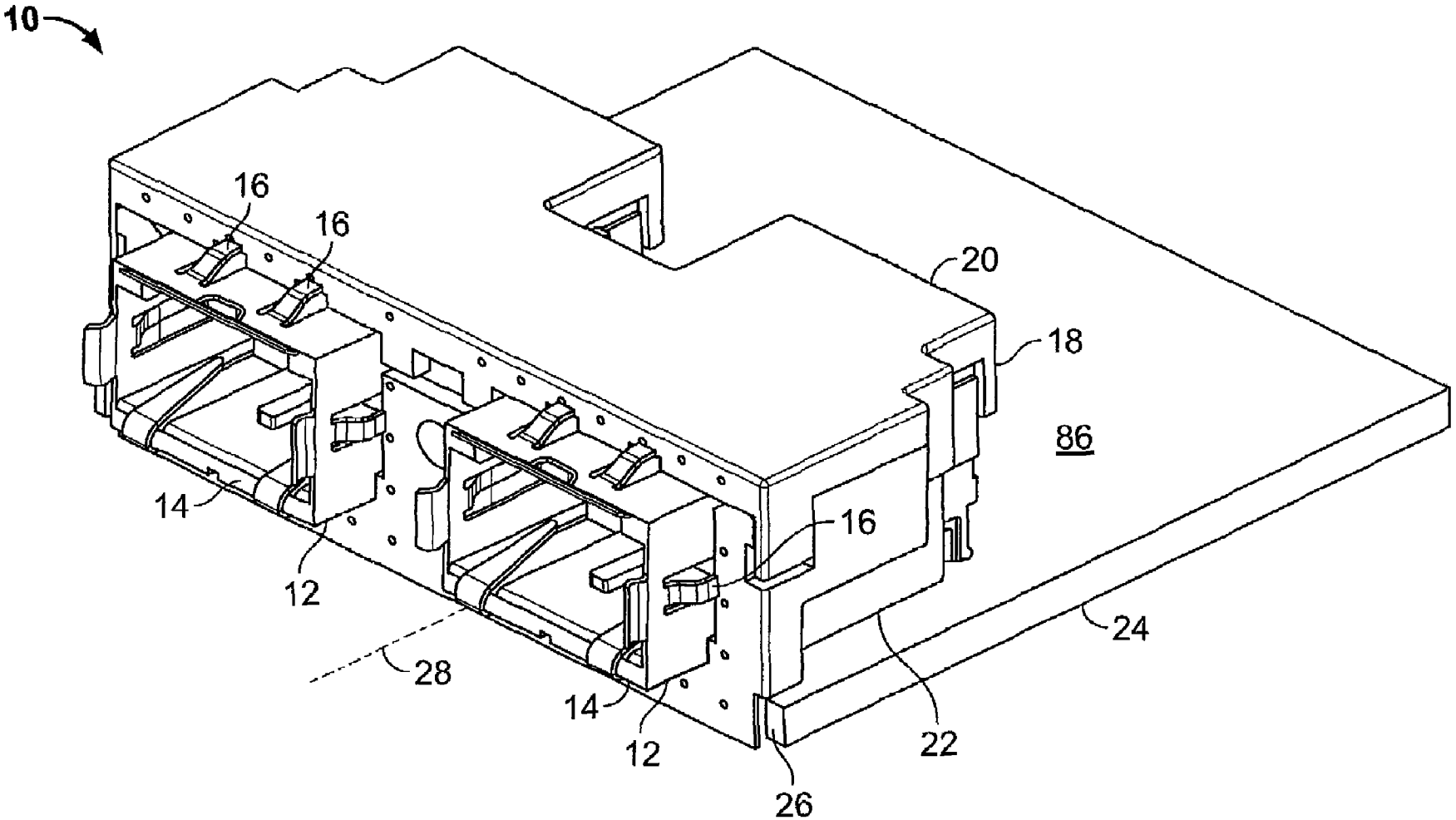
FIG. 1 is a top perspective view of an embodiment of an electrical connector assembly for use with a panel member of the present invention.
Figure 2:
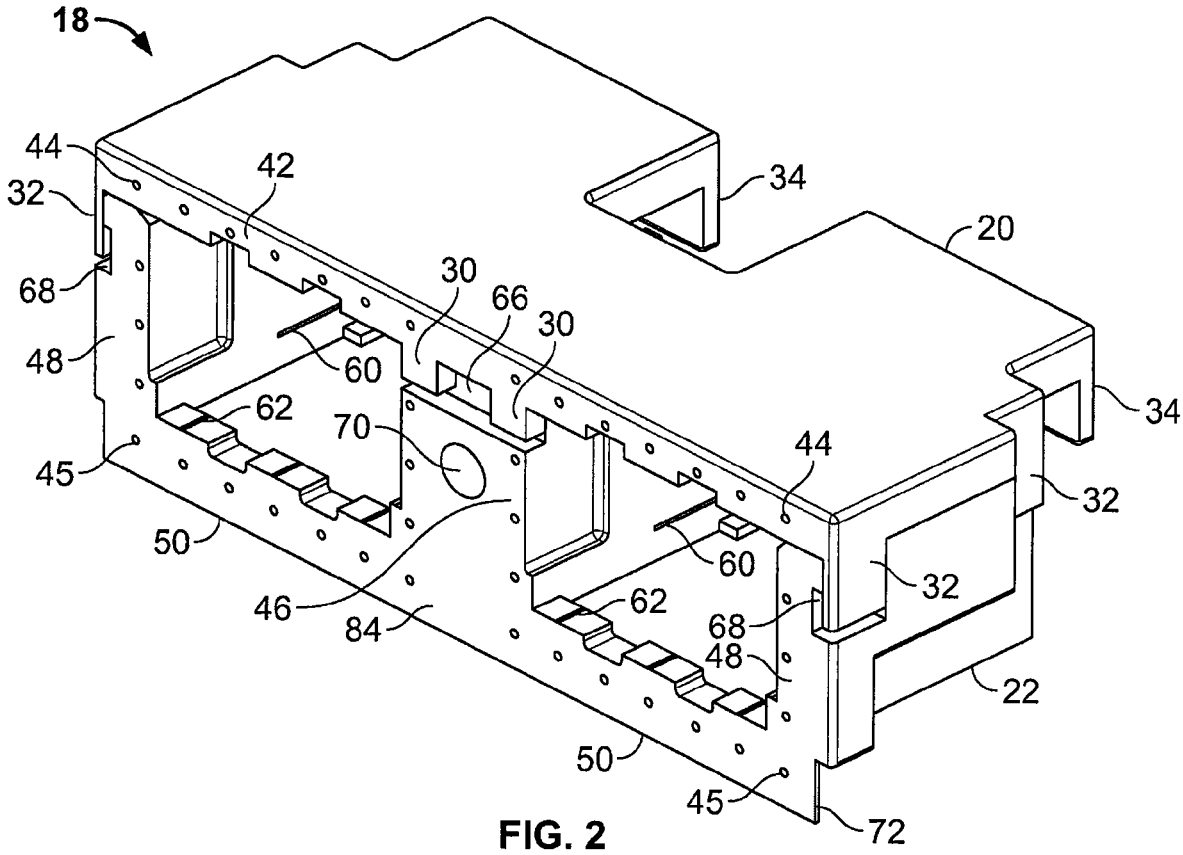
FIG. 2 is a top perspective view of an embodiment of a bracket for use with an electrical connector assembly of the present invention.

Referring to FIG. 1, an electrical connector assembly 10 according to the present invention includes a connector 12 having a housing 14 that is received by bracket portions 20, 22 of EMI bracket or bracket 18. As shown in FIG. 2, bracket portion 20 can also be referred to as an upper bracket portion 20 and bracket portion 22 can also be referred to as a lower bracket portion 22, although neither of terms upper and lower is intended to be limiting. In one embodiment, connector 12 is mounted on panel member 24, such as a printed circuit board, by a solder joint. However, other suitable techniques to secure connector 12 to panel member 24 may include fasteners, adhesives or locking constructions between connector 12 and panel member 24. As will be discussed in more detail below, bracket 18 is relatively movable along an axis 28 associated with connector 12 while maintaining electrical communication with connector 12, and without unduly stressing the affixed joint between connector 12 and panel member 24.

Referring to FIGS. 1-4, connector 12 (FIG. 1) includes a rectangular housing 14 having a width substantially parallel to an end 26 (FIG. 1) of panel member 24 and a length extending substantially transverse to its width. As further shown in FIG. 1, axis 28 is substantially parallel to the length of connector 12. In one embodiment, once connector 12 has been mounted on panel member 24, bracket 18 is installed, surrounding, or at least partially surrounding connector 12.

Figure 3:
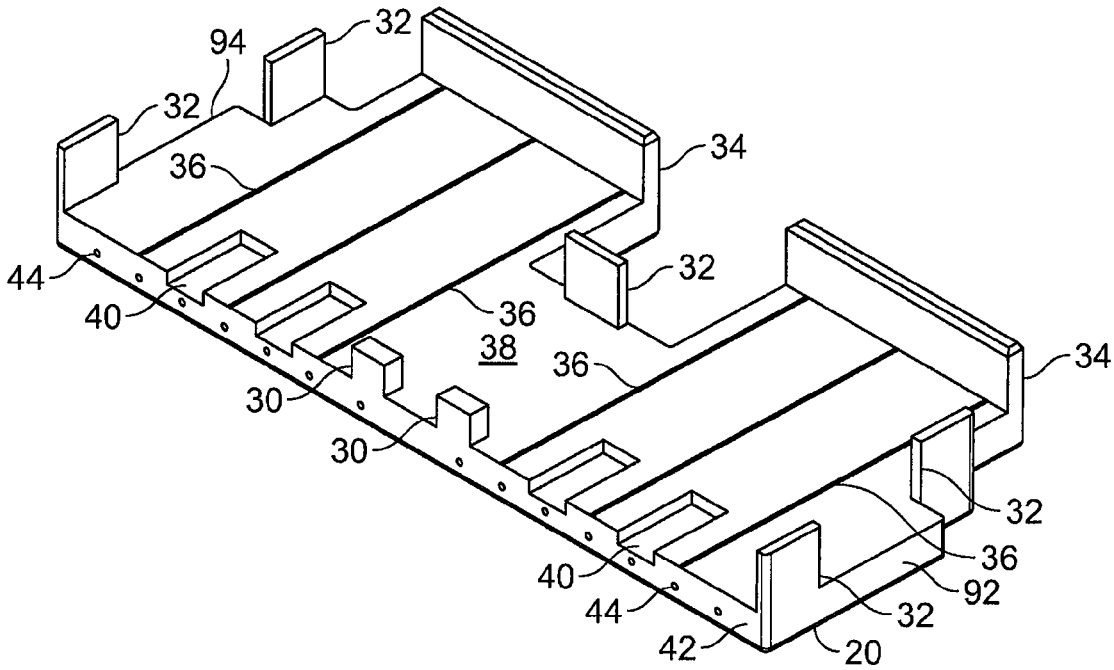
FIG. 3 is a bottom perspective view of an upper bracket portion of the present invention.
Figure 4:
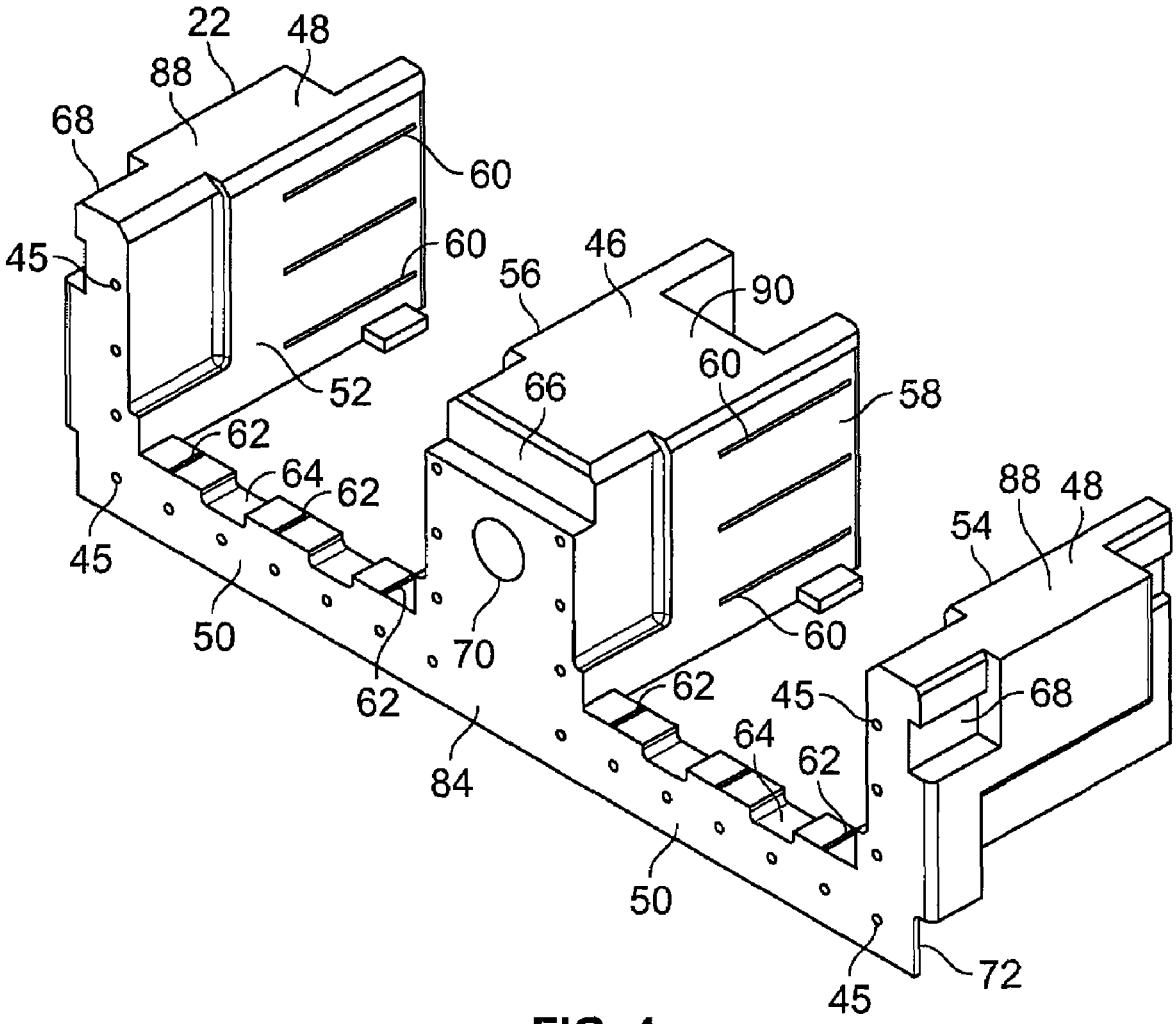
FIG. 4 is a top perspective view of a lower bracket portion of the present invention.

As shown in FIGS. 2-4, bracket 18 is comprised of bracket portions 20, 22. Bracket portion 20, which is shown inverted in FIG. 3 from its mated position with bracket portion 22 in FIG. 2, includes a surface 38. Bracket portions 20, 22 are composed of suitable conductive materials, such as zinc, copper and/or steel. Surface 38 includes, in one embodiment, two sets of three projections 36, such as raised ribs, extending outwardly from surface 38, which projections 36 are disposed substantially parallel with each other between a surface 42 and each of the pair of flanges 34. Projections 36 interface a surface of connector 12, maintaining electrical communication between bracket portion 20 and connector 12. It is appreciated that as shown in FIG. 1, the surfaces of connector 12 interfacing with projections 36 are substantially parallel with and facing away from a surface 86 of panel member 24. Adjacent to opposed ends 92, 94 and surface 42 are standoffs 32 extending outwardly from surface 38. An additional pair of standoffs 32 are similarly disposed adjacent to opposed ends 92, 94 and further spaced from surface 42. An additional standoff 32 is disposed substantially centered between opposed surfaces 92, 94 and further disposed between flanges 34. However, it is to be understood that standoffs 32 can be disposed in other suitable positions and in different quantities than the five standoffs 32 as shown in FIG. 3. As further shown in FIG. 3, standoffs 30 extend outwardly from surface 38. In addition, in one embodiment, recesses 40 found in surface 38 receive fingers 16 (FIG. 1) of connector 12. As will be discussed in further detail below, standoffs 30, 32 of bracket 20 are received in respective recesses 66, 68 of bracket 22.

Bracket portion 22 (FIG. 4) includes a body 46 having opposed arms 50 that extend outwardly from body 46 adjacent to surface 84 to opposed end portions 48. This construction provides a predetermined spacing between a surface 52 of end portion 48 and a surface 56 of body 46 configured to receive connector 12 (FIG. 1). Similarly, the spacing between a surface 54 of end portion 48 and a surface 58 of body 46 is configured to receive connector 12 (FIG. 1). In one embodiment, protrusions 60 extend along surface 52 of end portion 48, with corresponding protrusions 60 (not shown) extending along surface 56 of body 46. In addition, protrusions 60 extend along surface 58 of body 46, with corresponding protrusions 60 (not shown) extending along surface 54 of end portion 48. The corresponding protrusions 60 are configured to interface at least one surface of connector 12 that extends away from panel member 24, which as shown in FIG. 1, are the surfaces of connector 12 that extend transverse to surface 86 of panel member 24. In one embodiment, surfaces 88 of end portions 48 and a surface 90 of body 46 are substantially coplanar so that surfaces 88, 90 physically contact surface 38 of bracket portion 20 when bracket portions 20, 22 are assembled together to form bracket 18.

Arms 50, as shown in FIG. 4, include surfaces adjacent to and substantially perpendicular to surface 84. These surfaces include notches 64 configured to receive corresponding fingers 16 (not shown in FIG. 1) that outwardly extend from connector 12 toward panel member 24. In addition, in one embodiment, alternately disposed between notches 64, arms 50 include protrusions 62 for interfacing with a surface of connector 12 that is adjacent to, faces, and is substantially parallel to surface 86 of panel member 24, as shown in FIG. 1. Arms 50 further extend along surface 84 away from respective body 46 and end portions 48, forming a flange 72.

Upon assembly of bracket portions 20, 22 to form bracket 18, as shown in FIGS. 2-4, standoffs 30 are received by notch 66, standoffs 32 are received by respective recesses 68, and surfaces 88 of end portions and surface 90 of body 46 physically contact or abut surface 38 of bracket portion 20. In one embodiment, standoffs 30 and notch 66 interlock and/or standoffs 32 and corresponding recesses 68 interlock. However, it is to be understood that other interlocking features could be used to secure bracket portions 20, 22 together, or, alternately, that a unitary construction could be used. As shown, protrusions 36, 60, 62 combine to interface with each external surface of connector 12 extending through bracket 18, each protrusion 36, 60, 62 being in electrical communication with a corresponding surface of connector 12. As a result of this enhanced electrical communication, EMI is substantially reduced over a broad frequency range of electrical signals, such as at least between 1 GHz and 17 GHz. It is noted that such enhanced electrical communication is substantially maintained between bracket 18 and connector 12 along any position of bracket 18 along axis 28 (FIG. 1).

Figure 5:
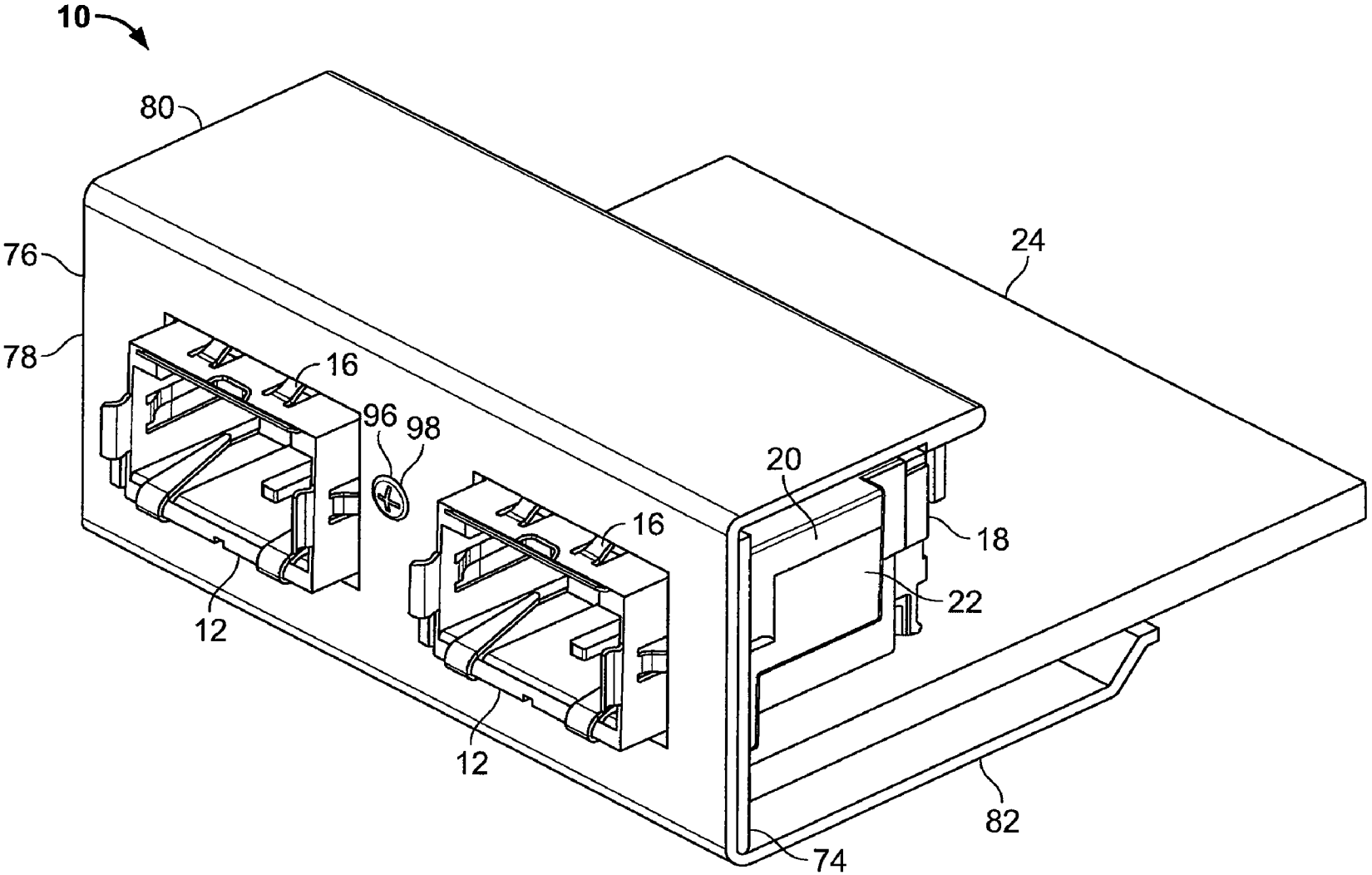
FIG. 5 is a top perspective view of an embodiment of a connector assembly for use with a panel member, the connector assembly secured to a bezel, of the present invention.
Figure 6:
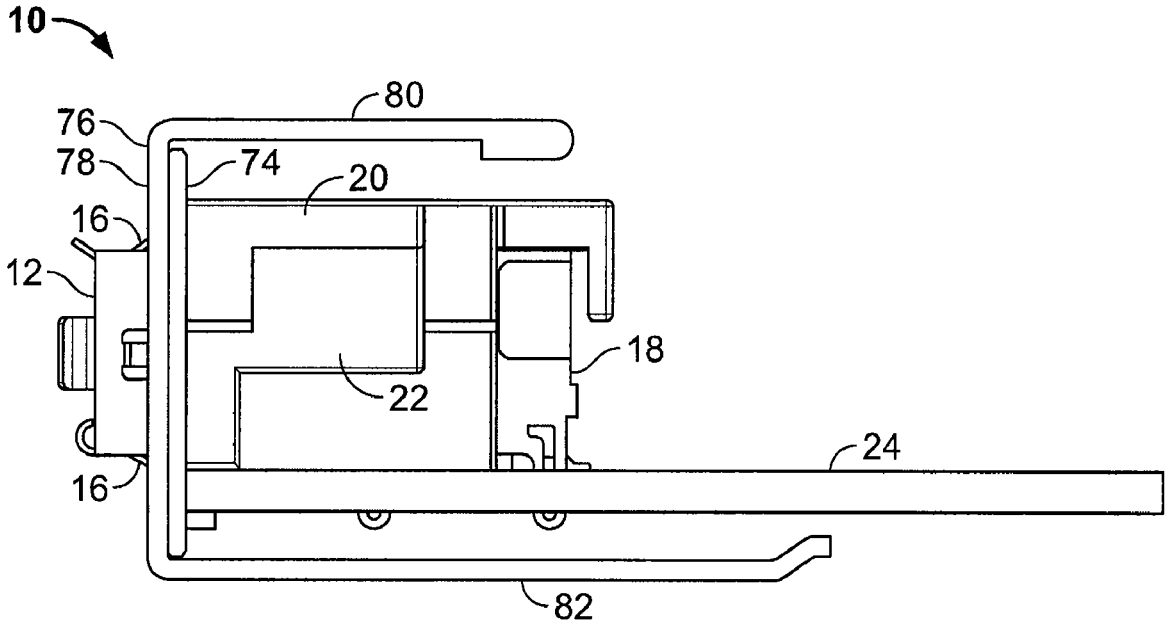
FIG. 6 is a side elevation view of an embodiment of the connector assembly of FIG. 5 of the present invention.

Referring to FIGS. 1-4, connector 12 is mounted on panel member 24 and bracket 18 at least partially surrounds connector 12 upon installation of bracket 18. Bracket 18 is relatively movable along axis 28 (FIG. 1) while maintaining electrical communication with connector 12. Referring to FIGS. 5-6, a resilient or elastomeric layer 74 of conductive material is applied over surface 42 (FIG. 3) of bracket portion 20 and surface 84 (FIG. 4) of bracket portion 22. In one embodiment, conductive layer 74 can be compressed to assure electrical contact between surfaces 42, 84. Protrusions 44, 45 (FIG. 2) enhance electrical communication between bracket portions 20, 22 and layer 74. Once layer 74 has been applied, a bezel 76 is then applied over layer 74. Bezel 76, as shown, is constructed of an electrically conductive material and includes a web 78 that extends from opposite ends to substantially parallel flanges 80, 82. To bring web 78 toward layer 74 to achieve the desired electrical communication with web 78, layer 74 and bracket 18, a fastener 96 is directed through an opening 98 formed in web 78 and then into a threaded aperture 70 (FIG. 4) formed in body 46 (FIG. 4). Upon sufficient actuation of the fastener in one direction, bracket 18 and web 78 are drawn toward each other, subjecting layer 74 to a compressive force to achieve the desired electrical communication between web 78, layer 74 and bracket 18. By virtue of the construction of the bracket 18 and connectors 12, bracket 18 is movable along axis 28 (FIG. 1) with respect to connector 12, maintaining electrical communication therebetween, without unduly stressing the joints affixing connector 12 to panel member 24 and the bracket 18 to bezel 76.

It is to be understood that bezel 76 represents a portion of an electrical appliance inside of which or against which connector assembly 10 is inserted or secured so that there is minimal EMI associated with operation of the electrical appliance. Stated another way, there is maximum EMI shielding between bezel 76 and the connector assembly 10. It is also to be understood that the fastener securing bezel 76 to bracket 18 is not intended to structurally support connector assembly 10 or panel member 24. Such structural support is typically provided by other structural components of the electrical appliance. It is also to be understood that bezel 76 can take any number of other structural constructions, so long as bezel 76 and bracket 18 can be sufficiently drawn together to achieve the desired electrical communication therebetween to minimize EMI.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A connector assembly comprising:

a connector configured for mounting on a panel member, the connector having an axis; and an EMI bracket at least partially surrounding the connector, the EMI bracket being slidably mounted on the connector for relative movement along the axis while maintaining electrical communication with the connector;

wherein the EMI bracket is affixed to and in electrical communication with a bezel, and a layer of conductive material is disposed between the EMI bracket and the bezel.

2. The connector assembly of claim 1 wherein the axis is parallel to a plane of the panel member.

3. A connector assembly comprising:

a connector configured for mounting on a panel member, the connector having an axis;

an EMI bracket at least partially surrounding the connector, the EMI bracket being relatively movable along the axis while maintaining electrical communication with the connector; and the EMI bracket affixed to and in electrical communication with a bezel, a layer of conductive material disposed between the EMI bracket and the bezel.

4. The connector assembly of claim 1 wherein the EMI bracket is affixed to the bezel by a fastener.

5. A method for assembling a connector assembly, the steps comprising:

providing a panel member, a connector having an axis, a bezel, a layer of conductive material and an EMI bracket;

mounting the connector on the panel member;

at least partially surrounding the connector with the EMI bracket, the EMI bracket being relatively movable along the axis while maintaining electrical communication with the connector, inserting the layer of conductive material between the EMI bracket and the bezel; and affixing the EMI bracket to the bezel, the EMI bracket in electrical communication with the bezel.

6. The connector assembly of claim 1 wherein the EMI bracket includes a plurality of protrusions that provide a sliding interface between the EMI bracket and the connector.

7. The connector assembly of claim 6 wherein the plurality of protrusions are disposed along at least one surface of the connector extending away from the panel member.

8. The connector assembly of claim 6 wherein the plurality of protrusions are disposed along at least one surface of the connector disposed substantially parallel to the panel member.

9. The connector assembly of claim 3 wherein the EMI bracket is affixed to the bezel by a fastener.

10. The connector assembly of claim 1 wherein a plurality of protrusions are formed in the EMI bracket along an interface between the EMI bracket and the bezel.

11. The connector assembly of claim 3 wherein the connector is affixed to the panel member by a solder joint.

12. The connector assembly of claim 3 wherein a plurality of protrusions are formed in the EMI bracket.

13. The connector assembly of claim 12 wherein the plurality of protrusions are disposed along an interface between the EMI bracket and the bezel.

14. The connector assembly of claim 3 wherein the EMI bracket includes a plurality of protrusions formed along an interface between the EMI bracket and the connector.

15. The connector assembly of claim 12 wherein the plurality of protrusions are disposed along at least one surface of the connector extending away from the panel member.

* * * * *